United States Patent [19]

Le

[11] Patent Number: 5,064,164

[45] **Date of Patent: * Nov. 12, 1991**

[54] BOP SEAL WITH IMPROVED METAL INSERTS

[75] Inventor: Tri C. Le, Sugar Land, Tex.

[73] Assignee: Baroid Technology, Inc., Houston, Tex.

[ * ] Notice: The portion of the term of this patent subsequent to Apr. 30, 2008 has been disclaimed.

[21] Appl. No.: 641,856

[22] Filed: Jan. 16, 1991

Related U.S. Application Data

[63] Continuation of Ser. No. 568,600, Aug. 16, 1990, Pat. No. 5,011,110.

[51] Int. Cl.[5] ..... E21B 33/06

[52] U.S. Cl. ..... 251/1.1; 251/1.3; 277/178

[58] Field of Search ..... 251/1.1, 1.3; 277/113, 277/178, 179, 234

[56] References Cited

U.S. PATENT DOCUMENTS

| | | | |
|---|---|---|---|
| 2,035,925 | 3/1936 | Seamark . | |
| 2,609,836 | 9/1952 | Knox . | |
| 3,434,729 | 3/1969 | Shaffer et al. . | |
| 3,572,628 | 3/1971 | Jones . | |
| 3,915,424 | 10/1975 | LeRouax . | |
| 3,915,426 | 10/1975 | LeRouax . | |
| 3,958,808 | 5/1976 | Lewis . | |
| 4,444,404 | 4/1984 | Parks . | |
| 4,447,037 | 5/1984 | Huey et al. . | |
| 4,540,046 | 9/1985 | Granger | 166/55 |
| 4,930,745 | 11/1989 | Granger et al. | 251/1.1 |

*Primary Examiner*—John C. Fox

*Attorney, Agent, or Firm*—Browning, Bushman, Anderson & Brookhart

[57] ABSTRACT

A blowout preventer is provided with an improved sealing assembly for sealing engagement with a pipe extending through the blowout preventer into a well bore. The sealing assembly includes an elastomeric seal and a plurality of circumferentially spaced metal inserts within the seal for substantially minimizing or preventing extrusion of the seal under high fluid pressure. The BOP be reliably used for sealing engagement with pipes of varying diameters. Each insert has a substantially I-shaped configuration with an upper flange, a lower flange, and a rib fixedly interconnecting the flanges. A slot is provided within at least one of the flanges and forms a cavity for receiving a male interconnecting member extending circumferentially from an adjacent one of the inserts, such that the circumferentially spaced inserts are interconnected to minimize extrusion gaps between the inserts and to better enable the sealing assembly to form a positive seal with the pipe.

20 Claims, 2 Drawing Sheets

BOP SEAL WITH IMPROVED METAL INSERTS

This is a continuation of application Ser. No. 07/568,600, filed Aug. 16, 1990.

BACKGROUND OF THE INVENTION

1. Field of the Invention

The present invention relates to blowout preventors commonly used in oil and gas drilling operations to seal fluids within the well bore. More particularly, the present invention relates to a sealing or packing element of a ram-type blowout preventer with improved metal inserts to prevent extrusion of the sealing element.

2. Description of the Background

Ram-type blowout preventers or BOPs are commonly provided on wellheads for sealing with pipe and thereby retaining high pressure within the well bore. The BOP commonly employs a pair of semi-circular ram rubbers, each of which move simultaneously for sealing engagement with the pipe in response to application of high fluid pressure to the opposing ram cylinders In the past decade, increased emphasis has been placed upon BOPs which are capable with sealing with variable diameter pipe, thereby minimizing the number of blowout preventors required at the drilling site.

Since at least the 1930's, those skilled in the art of blowout preventers have recognized the desirability of utilizing metal plates or segments which may be at least partially embedded within the ram rubber to increase the integrity of the seal under high pressure. These metal segments are typically arranged circumferentially about each semi-circular ram rubber, as disclosed in U.S. Pat. No. 2,035,925, and inherently move closer as the BOP rams move radially inward to engage the pipe. U.S. Pat. No. 3,434,729 discloses a BOP ram assembly, and teaches the use of metal plates spaced above and below the ram rubber to inhibit the extrusion of rubber under high pressure. Although the metal plates as disclosed in the '729 patent have been widely used, many BOP operators prefer the characteristics of BOP sealing elements which include a plurality of circumferentially-spaced metal inserts imbedded within the ram rubber.

BOP metal inserts are preferably provided adjacent both the upper and lower ends of each of the opposing BOP seals. A significant advantage of providing the elements at the lower end of the BOP seal is that the entire BOP sealing assembly may be inverted during an emergency, so that the bottom inserts are now the top inserts and serve to prevent extrusion of the sealing element and thereby retain the high pressure fluid within the well bore. Such metallic inserts functionally are provided in two general types: (1) inserts within the elastomeric sealing material which are adapted for engagement with the pipe which passes through the BOP, and (2) inserts which are not adapted to engage the BOP pipe but only reinforce the elastomeric or rubber seal, so that a layer of the rubber seal is provided between the radially inwardmost surface of the metal inserts and the pipe.

One type of metal inserts for a BOP seal is disclosed in U.S. Pat. No. 3,572,628. The inserts as shown in FIG. 8 of this patent are substantially I-shaped, with the upper and lower flanges of each insert positioned adjacent the upper and lower ends of the BOP sealing element. U.S. Pat. No. 2,609,836 discloses a blowout preventor with "control elements" that are either I-shaped, as shown in FIGS. 13–15, or are cup-shaped, as shown in FIGS. 39–42. One advantage of the cup-shaped control elements is that these elements may interlock. U.S. Pat. No. 3,915,424 discloses anti-extrusion elements which are positioned adjacent the upper and lower surfaces of the BOP seal, and overlap and interlock so that the radially inward-most surface of the elements contacts the pipe. A particular type of interlocking mechanism for anti-extrusion elements of a BOP seal is disclosed in U.S. Pat. No. 3,915,426.

Advantages are obtained by using metal inserts for a BOP seal wherein the upper metal inserts and the lower metal inserts are interconnected, in the manner of the I-beam design discussed above. Compared to separate upper and lower insert designs, less individual components of the seal assembly are used, and the I-beam design also promotes the uniform movement of the inserts toward the pipe. U.S. Pat. No. 3,958,808 discloses I-beam inserts as shown in FIG. 9 with "buttons" to better secure the metal inserts to the elastomeric material of the sealing element. U.S. Pat. No. 4,444,404 discloses a BOP packing element with I-beam metal inserts having "stair-stepped" flanges. U.S. Pat. No. 4,447,037 disclosed another version of I-beam inserts for a BOP seal, with the metal inserts having a configuration as shown in FIGS. 6 and 7 of this patent.

Prior art BOPs have disadvantages which have limited their acceptance in the oil and gas exploration industry. Some of the BOPs employ sealing assemblies which do not include circumferentially spaced metal inserts to minimize extrusion of the sealing material, while other BOPs employ metal plates above and below the rubber sealing element to control extrusion. Of the BOPs which utilize circumferentially spaced metal inserts, the type of inserts which fixedly interconnect an upper insert member to a lower insert member are generally preferred over those Which utilize separate upper and lower insert members. BOP sealing inserts which interlock, such that significant extrusions gaps are eliminated between adjacent members, and which uniformly close around the pipe to create a seal are preferred, although such BOP's are generally expensive. Improved techniques are thus required to provide a relatively low cost sealing assembly for a BOP which does not suffer from the disadvantages of the prior art, and which can effectively prevent extrusion of the BOP sealing material.

The disadvantages of the prior art are overcome by the present invention, and an improved blowout preventer, a sealing assembly for a blowout preventer, and metal inserts for the sealing assembly of a blowout preventer are hereinafter disclosed which overcome the disadvantages of prior art BOPs.

SUMMARY OF THE INVENTION

A ram assembly for a blowout preventer (BOP) includes a pair of opposing hydraulic drive rams and a corresponding pair of opposing ram blocks each movable radially inward toward a pipe within the BOP. Each ram block includes upper and lower metal plates, and a sealing assembly comprising an elastomeric seal and a plurality of circumferentially spaced metal inserts within the elastomeric seal to prevent extrusion of the seal under high pressure. The metal inserts are spaced about each of the semi-circular elastomeric seals, and as the BOP is closed the inserts move closer together to form a reduced diameter ring of inserts about the pipe. The BOP is operated by fluid pressure in a conventional manner, and may close about a specific diameter pipe or pipe having a variable diameter range.

Each of the metal inserts has a generally I-beam configuration, with upper and lower flanges respectively positioned within the upper and lower portions of the elastomeric seals, and a rib fixedly interconnecting the upper and lower flanges. Each flange has a radially inwardmost surface for pressing elastomeric material into engagement with the pipe while substantially minimizing or preventing extrusion of the elastomeric material, although the metal insert themselves do not contact the pipe. The plurality of upper and lower flanges thus form respective upper and lower flange rings within the elastomeric seals, with the flanges moving closer together to reduce the diameter of each of the flange rings as the rams force the sealing assemblies radially inward. At least one of the flanges includes a female slot preferably defined entirely by the flange, and a male connecting member extends circumferentially from the flange of an adjacent metal insert. The male member of one metal insert thus slides within a respective slot of an adjacent insert to interlock the inserts. The interconnected metal inserts do not permit extrusions gaps between adjacent members, and contribute to the opposing seals uniformly closing about the pipe to create a positive seal under high pressure.

It is an object of the present invention to provide an improved sealing assembly for a blowout preventer with a plurality of circumferentially arranged I-shaped metal inserts for preventing or minimizing extrusion of the seals.

It is a further object of this invention to provide improved interlocking metal inserts for a BOP sealing assembly, with each of the metal inserts including a flange having a female slot on one side and a male member extending outward from the other side of the flange for sliding engagement within a slot of an adjacent member.

It is also an object of this invention to provide an improved blowout preventer with a sealing assembly comprising a pair of semi-circular shaped elastomeric seals and improved metal inserts within each of the elastomeric seals.

It is a feature of the invention that the novel metal inserts overlap so that large extrusion gaps do not exist between adjacent inserts.

It is a further feature of the invention that the sealing assembly is designed to uniformly close about a pipe to create a positive seal therewith by providing a plurality of improved interlocking metal inserts spaced circumferentially about each of the sealing members.

It is a further feature of this invention that an improved blowout preventer with the sealing assembly may be reliably utilized for sealing over a range of pipe sizes.

It is an advantage of the present invention that the metal inserts are embedded entirely within the elastomeric material of the seal, and do not contact the pipe.

It is yet a further advantage of this invention that a relatively large amount of elastomeric material may be provided rearward of the rib interconnecting the upper and lower flanges, and that the configuration of the upper and lower flanges substantially minimizes tearing of the elastomeric material.

It is a further advantage of the present invention that the metal inserts may be formed by a low-cost casting technique, thereby minimizing the cost of the BOP and the sealing assembly.

These and further objects, features and advantages of the present invention will become apparent from the following detailed description, wherein reference is made to the figures in the accompanying drawings.

DETAILED DESCRIPTION OF PREFERRED EMBODIMENTS

Figure 1:
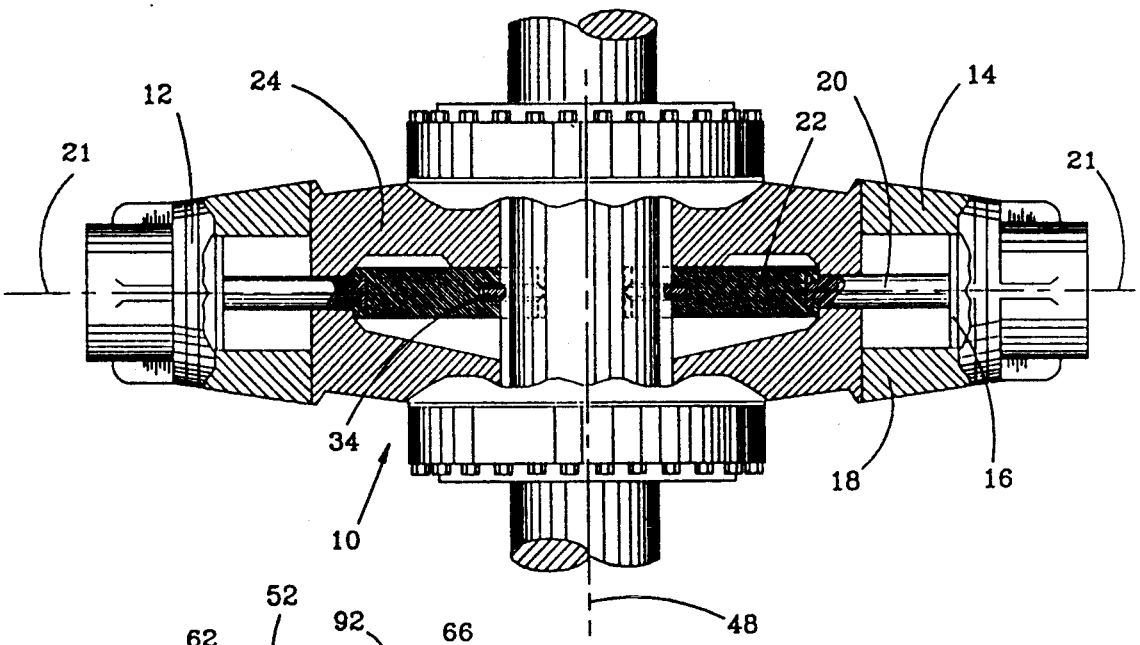
FIG. 1 is a side elevation, partially in cross-section, of one embodiment of a blowout preventer according to the present invention.

FIG. 1 illustrates generally a blowout preventer 10 according to the present invention in its open (not sealed) position. The blowout preventer is of the type designed for sealing with a pipe or similar tubular member within the BOP which may have a variable diameter, e.g., in the range of from 3½" to 5". The blowout preventer includes a pair of hydraulic ram assemblies 12, 14, with each ram assembly including a piston 16 within a cylinder 18, and a piston rod 20. Rod 20 extends from the piston and radially moves a ram block assembly 22 within the BOP body 24. Each side of the BOP is functionally indentical, and the ram assemblies are simultaneously activated by hydraulic pressure to force the opposing ram blocks into engagement with the pipe.

Figure 2:
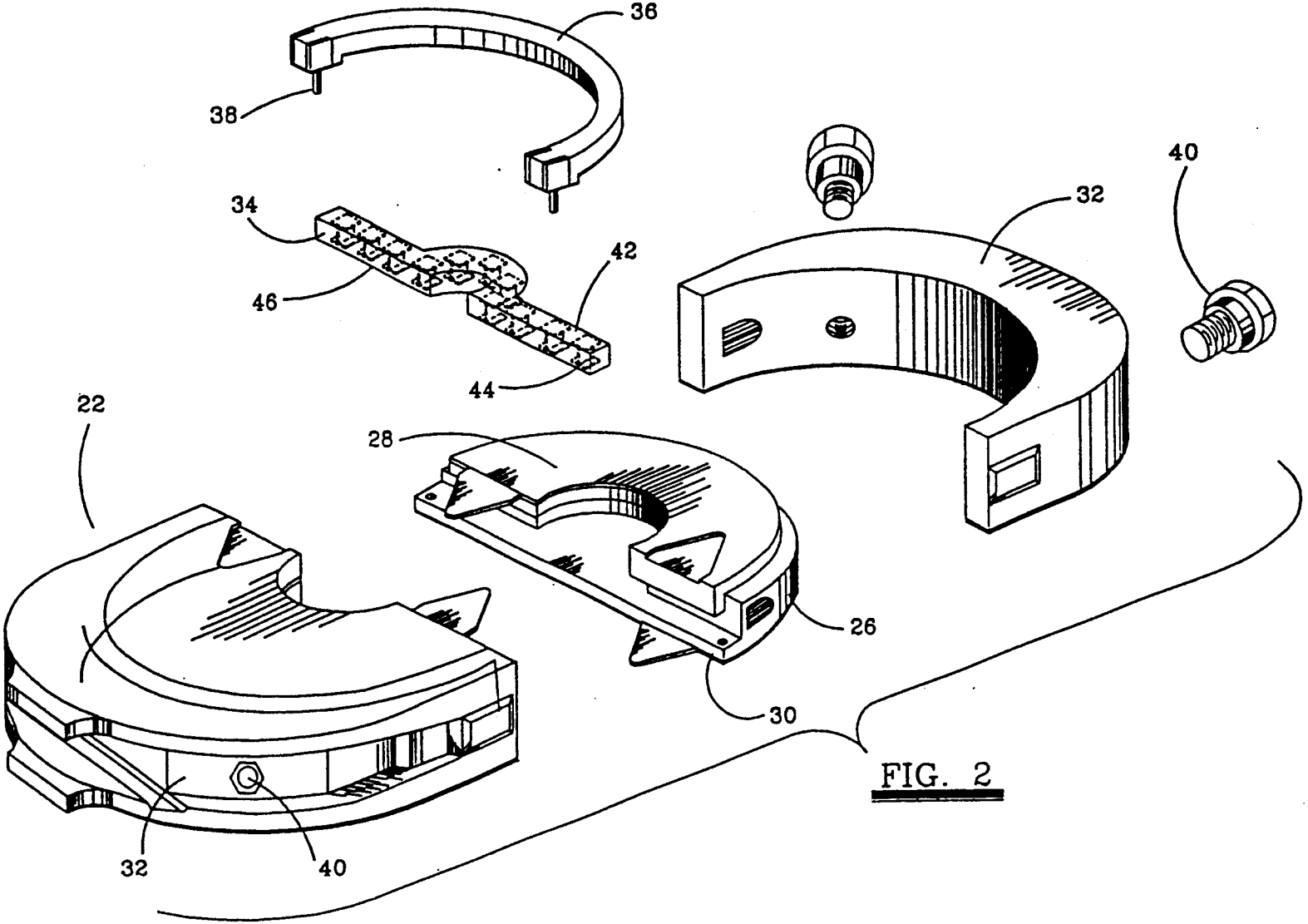
FIG. 2 is a pictorial, partially exploded view of the ram assemblies the blowout preventer generally shown in FIG. 1, with the general arrangement of the metal inserts within the elastomeric seal being shown in dashed lines.

The ram block assembly of the BOP according to the present invention is of the type generally available under the Shaffer trademark, and accordingly is not discussed in detail herein. Referring generally to FIG. 2, however, it should be understood that each of the opposing ram block assemblies 22 includes a ram block 26 having upper and lower metal plates 28, 30, a ram block holder 32, a face sealing assembly 34, a top seal member 36, and a pair of retracting screws 40. As shown in FIG. 2, a pair of pins 38 extend downward from the top seal member for interconnection with the bottom plate 30. It may be seen in FIG. 2 that the top and bottom plates 28, 30, as well as the ends of the semi-circular holder 32, substantially contain the face seal assembly 34 within the ram block assembly 22 to limit extrusion of the rubber or sealing member under high fluid pressure.

The face sealing assembly 34 comprises an elastomeric material seal 42 and a plurality of circumferentially spaced metal inserts each embedded within the elastomeric sealing element. The seal or sealing elements 42 and 36 may be fabricated from various resilient materials commonly used for BOP seals, and preferably are fabricated as a monolithic component for each of the ram block assemblies, or as separate top seal and face seal components within a ram block, as depicted in FIG. 2, and is generally referred to as a BOP rubber. Each face sealing assembly 34 and its associated sealing element or rubber 42 has a generally semi-circular configuration adapted for engagement with the pipe. The rubber as shown in FIG. 2 has a pair of opposing leg members 44, 46 each extending outwardly from the generally semi-circular configuration of the rubber. Metal inserts as discussed below are provided within each of the semi-circular rubbers 42, and preferably are also provided within the legs extending outwardly from the rubber. The general arrangement of these inserts within the rubber is depicted in FIG. 2, with the inserts generally shown in dashed lines.

Figure 3:
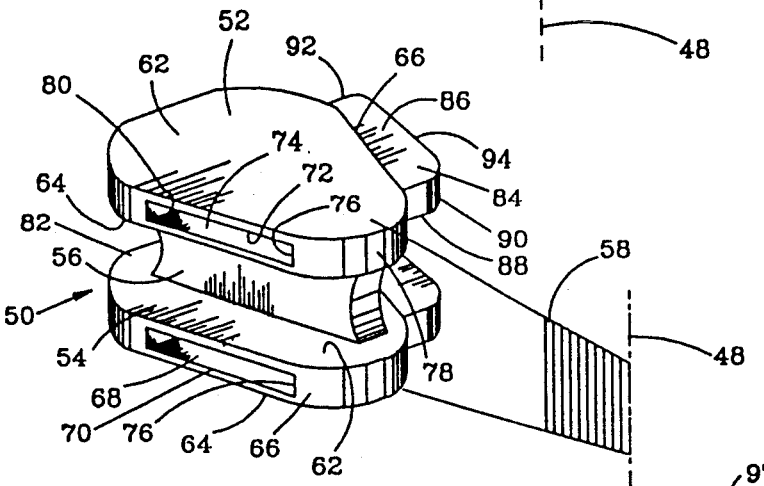
FIG. 3 is a pictorial view of one of the metal inserts generally shown in FIG. 2.

FIG. 3 depicts one of the metal inserts 50 which are embedded at least substantially, and preferably entirely, within the rubber of each of the sealing assemblies 34. Each insert 50 has an upper flange 52, a lower flange 54, and a rib 56 interconnecting the upper and lower flanges. With the exception of the slot and interconnecting members discuss subsequently, each insert within the semi-circular configuration at the seal assembly 34 is arranged substantially symmetrical about a centerline plane 58, which is aligned with and passes through the central axis 48 of the BOP. Each flange has a substantial planar top surface 62 and a substantially planar bottom surface 64, with each of these surfaces being perpendicular to the insert centerline plane 58 and axis 48. The side and end surfaces 66 of each flange together define a generally curvalinear configuration to minimize rupture of tearing of the rubber, and these surfaces are preferably parallel to the axis 48 of the BOP. The central rib 56 lies within the plane 58. Each insert 50 within the semi-circular configuration of the sealing assembly 34 moves radially in and out with the rubber as the BOP closes and opens, while similar inserts within the leg portions of each of the rubbers moves within a plane parallel to the central axis 21 of the hydraulic ram assemblies (shown in FIGS. 1 and 4).

At least one of the top or bottom flanges define a sheet-like slot 68 having an opening 70 adjacent a side of the flange. The cavity formed by the slot is defined by the flange, and includes an upper substantially planar surface 72 and a lower substantially planar surface 74 each spaced between an preferably parallel to the top and bottom flange surfaces. The slot is further defined by a front surface 76 spaced radially outward from a radially innermost surface 78 of the flange, and a rear surface 80 spaced inwardly of the outermost end surface 82 of the flange. The slot thus forms a substantially rectilinear cavity within the flange, with the cavity having a single opening on the flange side.

A corresponding one or both of the flanges also include an interconnection member 84 extending circumferentially from an opposing side of a flange or flanges. The male member 84 has planar top and bottom surfaces 86, 88, front and rear surfaces 90, 92, and a side surface 94, with each of these surfaces adapted for sliding (or at least close tolerance) engagement with the corresponding surface of a slot 68 of an adjacent metal insert. Thus engagement of surfaces 90 and 76 limit radial movement of one insert with respect to its adjacent insert, while engagement of surfaces 86 and 72 limit axial movement of one insert with respect to its adjacent insert. The remaining surfaces of the slot and the male member similarly cooperate to prohibit any substantial radial or axial movement of one insert relative to its adjacent insert. It should be understood, of course, that each of the inserts is free to move in a circumferential direction with respect to other inserts as the BOP opens and closes, and that the spacing between the flanges of adjacent inserts is reduced and expands as the BOP closes and opens.

The design of the slot within one or both of the flanges of the I-shaped inserts and the utilization of the similarly-configured male member on an opposing side of the insert is a significant feature of the present invention, in that undesirable play between the metal inserts in any direction is eliminated or substantially reduced. Thus the metal inserts as Well as the rubbers move uniformly for sealing engagement of each sealing assembly 34 with the pipe, and substantial extrusion gaps between adjacent inserts minimizes extrusion or failure of the rubber under high pressures. The inserts of the present invention may be cost and, if necessary, machined, and provide the desired interlocking feature of inserts within a BOP sealing assembly at a relatively low cost.

Figure 4:
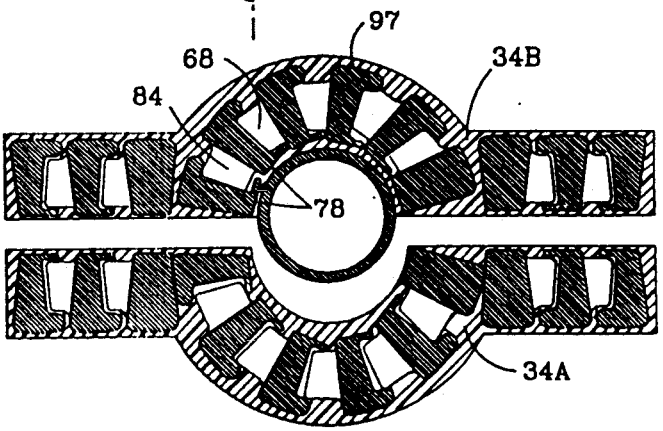
FIG. 4 is a cross-sectional view through the upper flange of the metal inserts of the sealing assembly generally shown in FIG. 2, with the metal inserts of the right-side sealing assembly shown in the BOP extended position, and the metal inserts and the left-side sealing assembly shown in the BOP compressed position.

FIG. 4 is a cross-sectional view of a pair of opposing sealing assemblies 34, with the right-side sealing assembly 34A being the BOP extended position and out of engagement with the pipe, and the left-side sealing assembly 34B being in the BOP compressed position so that its rubber is in positive sealing relationship with the pipe. FIG. 4 indicates the substantially identical configuration between the male member 84 of one metal insert and the cavity formed by the slot 68 of an adjacent metal insert. Also, FIG. 4 depicts that the radially inwardmost surface 78 of an insert does not engage the pipe, but rather compresses the layer of rubber 96 between this pipe and the insert. A outer layer of rubber 97 is preferably provided radially outward of an outermost surface of the inserts, and according to FIGS. 3 and 4 it should be understood that a substantial amount of rubber exist radially outward of each rib 56 to serve as additional material during high pressure sealing.

It should be understood that the male members 84 extending from each insert preferably project in the same direction, i.e., clockwise or counterclockwise, for both sides of the BOP. This allows a male insert from one BOP seal to project across the centerline plane of the BOP and lock in a slot of an insert within the opposing BOP seal. A continuous ring of fully locked inserts is thus preferably formed by the present invention.

It should thus be understood that the inserts of the present invention offer the advantages and features previously discussed. The inserts are preferably formed from metal, but may be formed from another relatively inexpensive rigid material. The dimensions of the insert and the rubber of the sealing assembly will change depending upon the size of the BOP and the desired configuration for these components. A significant advantage of the blowout preventer according to the present invention is that the entire blowout preventer may be turned upside down, so that the bottom flange effectively becomes the top flange to substantially restrict or minimize extrusion of the BOP rubber under high pressure within a well. The slot and male interconnecting members may be provided in either the top or bottom flange, and preferably in both flanges, as described herein, to further increase reliable sealing. These and other changes and modifications will be apparent to those skilled in the art from the foregoing description.

The foregoing disclosure and description of the invention are thus illustrative and explanatory, and various other changes in the components as well as in the configuration of these components may be made within the scope of the appended claims and without departing from the spirit of the invention.

What is claimed is:

1. A sealing assembly for a ram block of a blowout preventer for sealing with a pipe or the like within a well bore, the sealing assembly comprising:

a resilient seal having a generally arcuate portion adapted for engagement with the pipe;

a plurality of rigid inserts each at least substantially embedded within the seal and circumferentially arranged about the arcuate portion of the seal;

each insert including an upper flange, a lower flange, and a rib fixedly interconnecting the upper and lower flanges;

at least one of the upper flange and lower flange of each insert having a radially innermost surface for pressing the seal into sealing engagement with the pipe;

each insert having a slot within at least one of the upper and lower flanges, the slot having an opening adjacent a side of the flange and forming a cavity defined by the flange; and each insert further having a male interconnecting member extending circumferentially outward from an opposing side of the flange for sliding engagement within the slot of an adjacent member, such that the circumferentially spaced inserts are independently movable with respect to each other and are interconnected while the blowout preventer closes about the pipe.

2. The sealing assembly as defined in claim 1, wherein:

a slot and a male interconnecting member are provided for both the upper and lower flanges of each of the inserts.

3. The sealing assembly as defined in claim 1, wherein each of the upper and lower flanges comprises:

a substantially planar top surface;

a substantially planar bottom surface; and side and end surfaces together defining a generally curvalinear configuration.

4. The sealing assembly as defined in claim 3, wherein the slot is defined by an upper substantially planar surface and a lower substantially planar surface each spaced axially between the top and bottom surfaces of the flange.

5. The sealing assembly as defined in claim 4, wherein:

each flange has a radially outermost surface; and the slot is further defined by a front surface spaced outward of the corresponding radially innermost surface of the flange and a rear surface spaced radially inward of the corresponding radially outermost surface of the flange.

6. The sealing assembly as defined in claim 1, wherein the rib of each of the inserts lies within a plane which is substantially aligned with and passes through the axis of the blowout preventer.

7. The sealing assembly as defined in claim 6, wherein a rearwardmost portion of the rib of each of the inserts is spaced radially inward from the outermost surface of each of the upper and lower flanges.

8. The sealing assembly as defined in claim 1, wherein:

the seal includes a pair of opposing leg members each extending radially outward from an end of the arcuate portion of the seal; and additional metal inserts are provided within each of the leg members.

9. An insert for a sealing assembly including a resilient seal, the sealing assembly adapted for movement with a ram block of a blowout preventer for sealing with a pipe or the like, the insert comprising:

an upper flange;

a lower flange;

at least one of the upper flange and lower flange having a radially innermost surface for pressing the seal into sealing engagement with the pipe;

a rib fixedly interconnecting the upper and lower flanges;

a slot within at least one of the upper and lower flanges, the slot having an opening adjacent a side of the flange and forming a cavity defined by the flange; and a male interconnecting member extending outward from an opposing side of the flange for sliding engagement within slot of an adjacent member.

10. The insert as defined in claim 9, wherein:

the radially innermost surface is provided on both the upper and the lower flanges for pressing the seal into engagement with the pipe, and an innermost surface of the rib is positioned radially outward of the upper and lower innermost surfaces of the upper and lower flanges, respectively.

11. The insert as defined in claim 9, wherein:

a slot and a male interconnecting member are provided for both the upper and lower flanges of the insert.

12. The insert as defined in claim 9, wherein each of the upper and lower flanges comprises:

a substantially planar top surface;

a substantially planar bottom surface; and side and end surfaces together defining a generally curvalinear configuration.

13. The insert as defined in claim 12, wherein the slot is defined by an upper substantially planar surface and a lower substantially planar surface each spaced axially between the top and bottom surfaces of the flange.

14. The insert as defined in claim 13, wherein:

each flange has a radially outermost surface; and the slot is further defined by a front surface spaced outward of the corresponding radially innermost surface of the flange and a rear surface spaced radially inward of the corresponding radially outermost surface of the flange.

15. A blow preventer for sealing engagement with a pipe or the like within a well bore, comprising:

a pair of opposing ram assemblies, each ram assembly including a cylinder, a piston movable within the cylinder, a rod extending inward from the piston, and a ram block including upper and lower plates at an inner end of each rod;

a pair of opposing seal assemblies each carried by a respective one of the ram blocks and radially movable for engagement and disengagement with the pipe, each seal assembly including a resilient seal for engaging the pipe and spaced axially between the upper and lower plates of the ram block, and a plurality of inserts at least substantially embedded within the seal for minimizing or preventing extrusion of the seal; and each of the inserts includes an upper flange having an upper radially innermost surface, a lower flange having a lower radially innermost surface, a rib fixedly interconnecting the upper and lower flanges, a slot within one of the upper and lower flanges having an opening adjacent a side of the flange and forming a cavity defined by the flange, and a male member extending from an opposing side of the flange for sliding engagement within the slot of an adjacent member, such that the circumferentially spaced inserts are interconnected while the blowout preventer closes about the pipe.

16. The blowout preventer as defined in claim 15, wherein:

a slot and a male interconnecting member are provided for both the upper and lower flanges of each of the inserts.

17. The blowout preventer as defined in claim 15, wherein each of the upper and lower flanges comprises:

a substantially planar top surface;

a substantially planar bottom surface; and side and end surfaces together defining a generally curvalinear configuration.

18. The blowout preventer as defined in claim 17, wherein the slot is defined by an upper substantially planar surface and a lower substantially planar surface each spaced axially between the top and bottom surfaces of the flange.

19. The blowout preventer as defined in claim 18, wherein:

each flange has a radially outermost surface;

the slot is further defined by a front surface spaced outward of the corresponding radially innermost surface of the flange and a rear surface spaced radially inward of the corresponding radially outermost surface of the flange; and each rib of each of the inserts lies within a plane which is substantially aligned with and passes through the axis of the blowout preventer.

20. The blowout preventer as defined in claim 15, wherein:

the seal has a generally arcuate portion and a pair of opposing leg members each extending radially outward from an end of the arcuate portion of the seal; and additional metal inserts are provided within each of the leg members.

* * * * *

UNITED STATES PATENT AND TRADEMARK OFFICE

CERTIFICATE OF CORRECTION

PATENT NO. : 5,064,164

DATED : November 12, 1991

INVENTOR(S) : Tri C. Le

It is certified that error appears in the above-identified patent and that said Letters Patent is hereby corrected as shown below:

In Column 8, line 47 (Claim 15, line 1), change "blow" to -- blowout --.

Signed and Sealed this

Sixth Day of April, 1993

*Attest:*

STEPHEN G. KUNIN

*Attesting Officer*

*Acting Commissioner of Patents and Trademarks*